United States Patent [19]

Takayama et al.

[11] 4,173,204

[45] Nov. 6, 1979

[54] CONTROL VALVE OF EXHAUST RECIRCULATION APPARATUS

[75] Inventors: Teruo Takayama; Kinsaku Yamada; Chiaki Niida, all of Katuta, Japan

[73] Assignee: Hitachi, Ltd., Japan

[21] Appl. No.: 851,429

[22] Filed: Nov. 14, 1977

[30] Foreign Application Priority Data

Nov. 17, 1976 [JP] Japan ..... 51-138777

[51] Int. Cl.[2] ..... F02M 25/06

[52] U.S. Cl. ..... 123/119 A; 137/479; 137/526; 251/31; 251/61

[58] Field of Search ..... 123/119 A, 117 A; 137/479, 480, 526; 251/61, 61.2, 61.5, 31

[56] References Cited

U.S. PATENT DOCUMENTS

| | | | |
|---|---|---|---|
| 3,802,402 | 4/1974 | Swatman | 123/119 A |
| 3,861,642 | 1/1975 | Maddocks | 123/119 A |
| 3,878,823 | 4/1975 | Vartanian | 123/119 A |
| 3,896,777 | 7/1975 | Masaki et al. | 123/119 A |
| 3,926,161 | 12/1975 | Wertheimer | 123/119 A |
| 3,931,813 | 1/1976 | Horie et al. | 123/119 A |
| 3,982,515 | 9/1976 | Bradshaw | 123/119 A |
| 4,031,871 | 6/1977 | Hamanishi | 123/119 A |
| 4,033,309 | 7/1977 | Hayashi et al. | 123/119 A |
| 4,057,043 | 11/1977 | Harada | 123/119 A |
| 4,092,960 | 6/1978 | Nohira et al. | 123/119 A |

*Primary Examiner*—Wendell E. Burns
*Attorney, Agent, or Firm*—Craig and Antonelli

[57] ABSTRACT

A control valve of an exhaust recirculation apparatus comprises an expansible vacuum chamber communicating with a venturi portion and having a first diaphragm and a spring urging the diaphragm to expand the chamber, an expansible exhaust pressure chamber having a second diaphragm disposed to oppose the first diaphragm at a distance and communicating with an exhaust inflow chamber, a control chamber disposed between the above chambers and defined by the first and second diaphragms and a frame mounting the first and second diaphragms thereon. The first and second diaphragms are connected by a bracket to which a seal member is secured through a block. In the control chamber is disposed a conduit one end of which has an opening facing the seal member with a gap therebetween, the other end communicates with a throttle portion and an exhaust gas recirculation valve provided in an exhaust recirculation passage. Upon increase of vacuum at the venturi portion, the diaphragms are moved to cause the seal member to approach and seal the opening in the conduit, whereby vacuum in the conduit is increased to open the exhaust recirculation of the exhaust gas, exhaust pressure in the exhaust inflow chamber is decreased to move the diaphragms so as to separate the seal member from the opening, so that the vacuum in the conduit will be decreased a little for the exhaust recirculation valve to be held at a suitable opening.

10 Claims, 2 Drawing Figures

CONTROL VALVE OF EXHAUST RECIRCULATION APPARATUS

BACKGROUND OF THE INVENTION

This invention relates to a control valve of an exhaust recirculation apparatus for an internal combustion engine of an automobile.

It is well known that part of the exhaust gas from an internal combustion engine is recirculated through the engine in order to restrict the production of nitrogen oxides (NOx). Usually, the quantity of exhaust gas recirculated is controlled by an exhaust gas recirculation valve (EGR valve) which controls the opening of an exhaust recirculation passage in accordance with the degree of vacuum being introduced into the EGR valve. The EGR valve is controlled by vacuum from various kinds of vacuum sources. For example, as described in U.S. Pat. No. 3,739,797, vacuum at a venturi portion of the carburetor is used, and U.S. Pat. No. 3,799,131 indicates in FIG. 7 thereof that the EGR valve is controlled by vacuum at a throttle portion of the carburetor, which vacuum is controlled by pressure in a zone defined in an exhaust recirculation passage by an orifice and the EGR valve.

There is a control valve for an exhaust recirculation apparatus which controls the EGR valve in accordance with vacuum from the throttle portion, which vacuum is controlled by the vacuum from the venturi portion and exhaust pressure in an exhaust inflow chamber corresponding to the above-mentioned zone just upstream of the EGR valve. The control valve has an exhaust pressure chamber with a diaphragm communicating with an exhaust inflow chamber defined in the exhaust recirculation by the EGR valve and an orifice disposed upstream of the EGR valve, a vacuum chamber defined by large and small diaphragms and communicating with a venturi portion of the carburetor, and a control chamber defined by the small diaphragm and a cover with an air hole communicating with the outside of the control chamber. The above-mentioned three diaphragms are mechanically connected to each other. In the control chamber there is disposed a vacuum passage which has an opening facing a seal member secured to the small diaphragm of the control chamber and which communicates with a throttle portion of the carburetor and the EGR valve. The control valve is further provided with a spring urging the diaphragms so that the seal member is parted from the opening of the vacuum passage.

Vacuum for controlling the EGR valve is controlled by adjusting the quantity of air flowing into the vacuum passage through the opening, and the quantity of air is controlled by the movement of the diaphragms according to the vacuum at the venturi portion and the exhaust pressure at the exhaust inflow chamber.

In the control device, in order to produce the driving force for the diaphragms in response to the vacuum induced into the vacuum chamber, the difference in area between the large diaphragm and the small diaphragm is used. Therefore, the control device, which employs two signals to control the vacuum for controlling the EGR valve in accordance with the vacuum from the venturi portion and the exhaust pressure in the exhaust inflow chamber, needs all three of the above-mentioned diaphragms, so that the movable portion of the control devices is very heavy. Because of the heavy portion, the control device has the inherent defect that its responsiveness is low. Further, because of the use of the three diaphragms, difficulty is encountered in assembling the control device.

SUMMARY OF THE INVENTION

An object of the invention is to provide a control valve for an exhaust recirculation apparatus which is able to control, with high responsiveness, an exhaust gas recirculation valve provided in an exhaust recirculation passage, and the vacuum supplied thereto, according to the degree of vacuum at a venturi portion of a carburetor and the exhaust pressure in an exhaust inflow chamber defined in the exhaust recirculation passage upstream of the exhaust gas recirculation valve by means of the exhaust gas recirculation valve and an orifice disposed in the exhaust gas recirculation passage.

Another object of the invention is to provide a control valve for an exhaust recirculation apparatus which can be easily assembled.

Briefly stated, a feature of the invention is the provision of a control valve for an exhaust recirculation system which controls the vacuum supplied to an exhaust gas recirculation valve for controlling the quantity of exhaust gas recirculated according to the degree of vacuum at a venturi portion of the carburetor and the exhaust pressure in an exhaust inflow chamber defined upstream of the exhaust gas recirculation valve by controlling the exhaust gas recirculation valve and an orifice in the vacuum line to the valve. The control valve is constructed with two diaphragms, that is, the control device comprises an expansible vacuum chamber having a first diaphragm and communicating with the venturi portion, an expansible exhaust pressures chamber having a second diaphragm and communicating with the exhaust inflow chamber, and a control chamber defined by the first and second diaphragms and communicating with atmosphere, in which control chamber the vacuum actuating the exhaust gas recirculation valve is controlled according to the movement of the diaphragms caused by the vacuum from the venturi portion and the exhaust pressure from the exhaust inflow chamber.

PREFERRED EMBODIMENTS OF THE INVENTION

Figure 1:
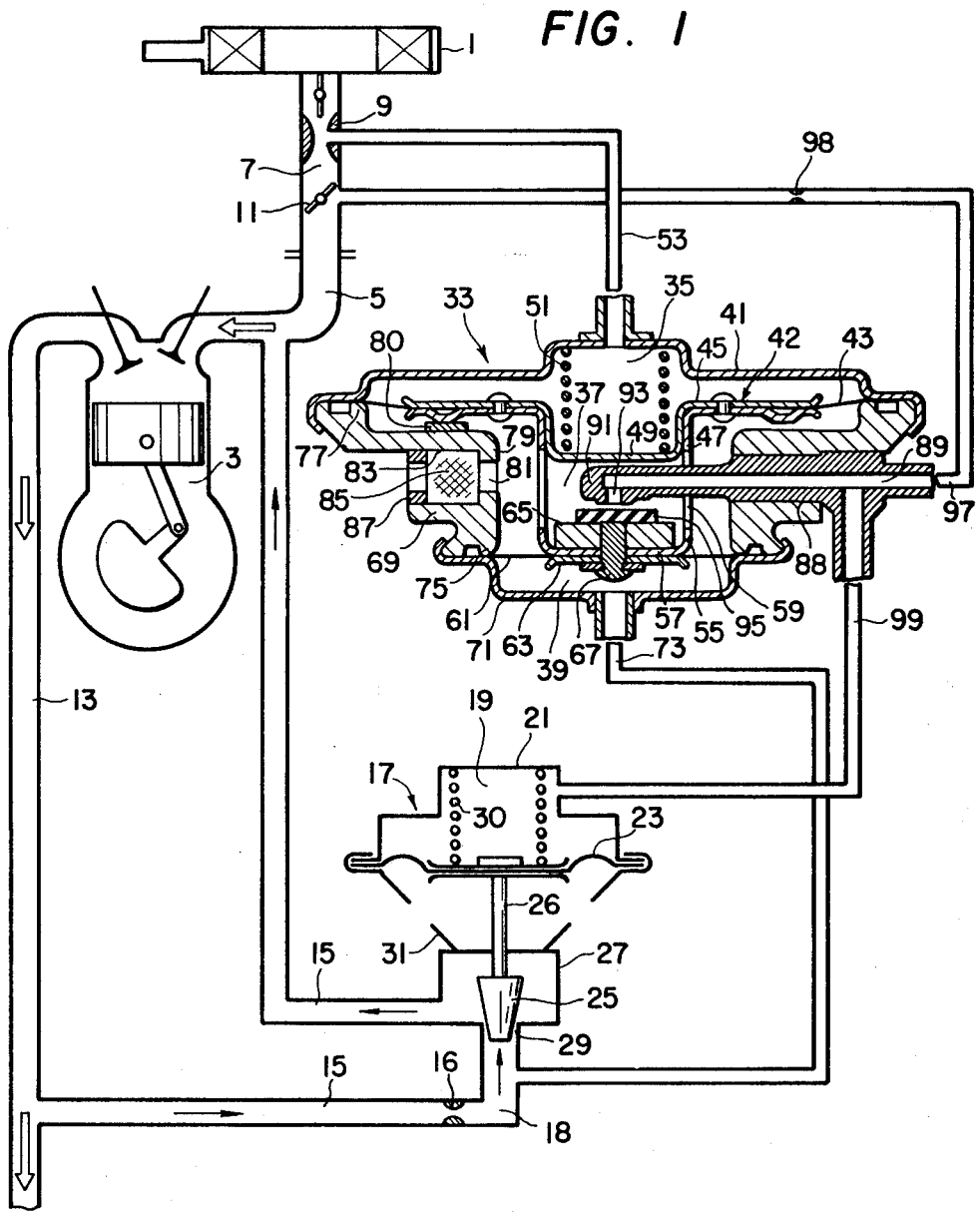
FIG. 1 is a schematic diagram of an exhaust recirculation apparatus which includes a sectional view of an embodiment of a control valve according to the invention.

Referring to FIG. 1, an embodiment of a control valve of an exhaust recirculation apparatus according to the present invention will be described hereinafter in detail.

In FIG. 1 air passed through an air filter 1 is introduced into an internal combustion engine 3 for automobiles through a carburetor 7 and a suction pipe 5, with fuel being mixed with the air in the usual manner. The mixed fuel and air is combusted in the engine 3, and the exhaust gas is discharged through an exhaust pipe 13 to atmosphere. Part of the exhaust gas is recirculated through the exhaust pipe 13, an exhaust recirculation pipe 15 having an orifice 16 and an exhaust gas recirculation valve 17 (hereinafter called the EGR valve), the suction pipe 5, and the engine 3.

The EGR valve 17 comprises a vacuum chamber 19 defined by a casing 21 and a diaphragm 23, a valve body 25 connected to the diaphragm 23 through a stem 26, a valve box 27 having a valve seat 29, a supporting member 31 for mounting the vacuum chamber 19 on the valve box 27, and a spring 30 urging the valve body 25 toward the valve seat 29. The valve box 27 is located in the exhaust recirculation pipe 15. The orifice 16 is disposed in the exhaust recirculation pipe 15 just upstream of the valve box 27 so that an exhaust inflow chamber 18 will be defined by the orifice 16 and the EGR valve 17. The EGR valve 17 controls the quantity of recirculation flow of the exhaust gas according to the degree of vacuum in the vacuum chamber 19 of the EGR valve 17, which vacuum is controlled by an exhaust recirculation control valve 33 (hereinafter simply called the control valve 33).

The control valve 33 comprises a vacuum chamber 35, a control chamber 37, and an exhaust pressure chamber 39. The vacuum chamber 35 is defined by a cover 41 and a diagram assembly 42. The diaphragm assembly 42 has a diaphragm 43, the periphery of which is air-tightly engaged with the cover 41 and the central portion of which is rigidly and air-tightly held between a backing plate 45 and a bracket 47. The backing plate 45 has a recess 49 formed in its central portion. In the recess 49, a spring 51 is disposed to expand the vacuum chamber 35 which communicates with the venturi 9 through a pipe 53 connected to the cover 41.

The bracket 47 is disposed in the control chamber 37 and has at its central portion a cup-shaped portion 55 which is provided with a flat bottom portion 57 spaced from the recess 49 of the backing plate 45 and with holes 59 in its side wall. On the flat bottom portion 57, a diaphragm 61 of smaller diameter than that of the diaphragm 43 is mounted, inserted between a backing plate 63 and the bracket 47, and fastened to the bracket 47 with a block 65 disposed inside the cap-shaped portion 55 by a rivet 67 integrated with or formed as a rivet portion 67 of the block 65. The periphery of the diaphragm 61 is air-tightly secured to a frame 69 by a cover 71 so that the exhaust pressure chamber 39 will be defined thereby. The cover 71 has a hole which communicates with the exhaust inflow chamber 18 through a pipe 73.

The frame 69 defines the control chamber 37 in cooperation with the diaphragm 61 and the diaphragm assembly 42, and has a smaller diameter portion mounting the diaphragm 61, a larger diameter portion 77 mounting the diaphragm 43 in the opposite side to the diaphragm 61, and a wall 79 extending from the smaller diameter portion 75 to the larger diameter portion 77. The wall 79 includes a cylindrical portion and a flange portion radially and outwardly spreading from the end of the cylindrical portion. To the large diameter portion 77, the periphery of the diaphragm 43 is fastened by the cover 41. The flange portion has a rest 80 mounted thereon which serves as a stopper to limit the movement of the diaphragm 43. The cylindrical portion has an air hole 81 and a recess 83 for holding a filtering material 85 in cooperation with an insert 87 with a hole, so that the control chamber 37 may communicate with the outside thereof through the air hole. The cylindrical portion is further provided with a conduit 89 passing through a hole 88 made in the cylindrical portion.

The conduit 89 has at its one end portion 91 a hole 93 which is open to the atmosphere and faces a seal member 95, such as a rubber plate, steel plate or the like, which seal member 95 is secured to the block 65. The hole 93 communicates with vacuum pipes 97 and 99 connected to the other end of the conduit 89. Through the vacuum pipes 97, 99, a throttle portion 11 of the carburetor 7 communicates with the vacuum chamber 19 of the EGR valve 17. The vacuum pipe 97 has an orifice 98 provided therein.

Next, operation of the control valve 33 will be described hereinafter referring to FIG. 1. Vacuum (signal) at the venturi portion 9, which is proportional to the quantity of air sucked into the engine 3, is inducted into the vacuum chamber 35 of the control valve 33 to move the diaphragm assembly 42. When the quantity of air sucked in is substantial, that is, when the engine 3 is running at high r.p.m., the vacuum (signal) becomes larger so that the diaphragm assembly 42 will be moved upwardly against the force of spring 51 to such an extent that the seal member 95 closes the hole 93 of the conduit 89, which has previously been open to the atmosphere. Upon the closure of the hole 93, vacuum in the vacuum pipes 97 and 99 is increased, so that the EGR valve 17 is opened for exhaust gas to be recirculated. By the recirculation of the exhaust gas, exhaust pressure in the exhaust inflow chamber 18 is decreased porportionally to the quantity of gas recirculated so that the pressure is reduced in chamber 39 and the seal member 95 is moved away from the hole 93 of the conduit. The vacuum in the vacuum pipes 97 and 99 is thereby decreased once again. Upon the decrease of the vacuum in the vacuum chamber 19, the valve body 25 of the EGR valve 17 is moved by spring 30 to be closed, thereby to decrease the quantity of the exhaust gas recirculated.

Thus, the EGR valve 17 is controlled by the control valve 33 to hold a proper opening degree according to the vacuum at the venturi portion 9 and the exhaust pressure in the exhaust chamber 18; that is, part of the exhaust gas from the engine 3 can be recirculated through the exhaust recirculation pipe 15, the orifice 16, the exhaust inflow chamber 18, the EGR valve 17 and the engine 3, with the quantity of exhaust gas recirculated being controlled according to the quantity of air sucked into the engine 3.

The EGR valve 17 is controlled with the vacuum from the venturi 9 and the exhaust pressure in the exhaust chamber 18 being amplified by the vacuum from the throttle portion 11 which is larger. The air in the control chamber 37 is drawn into the conduit 89 through the hole 93, passing through the filtering material 85 so that the air can be cleaned.

The control valve 33, which is controlled by the exhaust pressure in the exhaust inflow chamber 18 and the vacuum signal obtained from the venturi portion 9, includes only two diaphragms so that rapid or high responsiveness can be obtained because the weight of the movable portions, such as the diaphragm assembly 42 and the diaphragm 61, is light. Therefore, the control valve 33 can rapidly respond to an abrupt change in the quantity of air being sucked. Further, the control valve 33 can be easily assembled because of its simple construction.

Figure 2:
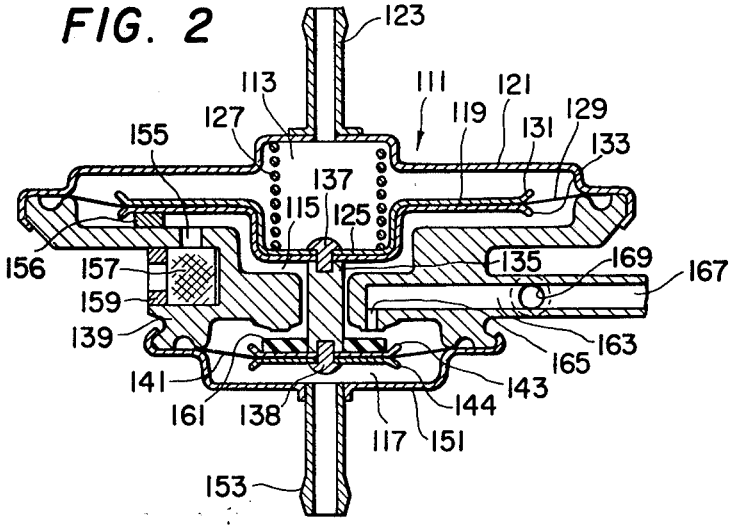
FIG. 2 is a sectional view of another embodiment of a control valve according to the invention.

Another embodiment of the present invention will be described hereinafter in detail referring to FIG. 2.

A control valve 111 comprises a vacuum chamber 113, a control chamber 115, and an exhaust pressure chamber 117. The vacuum chamber 113 is defined by a diaphragm assembly 119 and a cover 121 with a conduit 123. The diaphragm assembly 119 has a recess 125 formed in its center. In the recess 125, a spring 127 is disposed so that the vacuum chamber 113 will be expanded. The diaphragm assembly 119 comprises a diaphragm 129, two backing plates 131 and 133, and a connecting rod 135 by which the above-mentioned three members are integrated with the help of a rivet, a screw, or the like 137. The control chamber 115 is defined by the diaphragm assembly 119, a frame 139, and a small diaphragm 141. The small diaphragm 141 has a central portion interposed between two backing plates 143, 144 and secured to the connecting rod 135 by a rivet, screw, or the like 139 along with the backing plates 143, 144, and its periphery is air-tightly and rigidly mounted between the frame 139 and a cover 151 having a conduit 153. The control chamber has a hole 155 in the frame 139, through which the control chamber 115 communicates with the atmosphere. Outside the hole 155, filtering material 157 is mounted and held by an insert 159 having a hole so that air introduced into the control chamber 115 will be cleaned. The control chamber 115 has a seal member 161 made of rubber, metal sheet, etc., secured to the backing plate 143 and a passage 163 is provided in the frame 139. The one end 165 of the passage 163 is facing the seal member 161, and the other end communicates with two passages 167 and 169. The exhaust pressure chamber 117 is defined by the small diaphragm 141 and the cover 151 having the conduit 153.

The control valve 111 is used in the exhaust recirculation apparatus of FIG. 1, with the conduit 123, the passages 167, 169 and the concuit 153 being connected with the vacuum pipes 53, 97, 99 and the pipe 73, respectively. The control valve 111 is different from the control valve 33 in that the connecting rod 135 is used instead of the cup-shaped bracket 47, and the seal member 161 faces the hole 165 of the passage at a portion spaced from the center of the diaphragm 141.

The operation of the control valve 111 is the same as the control valve 33, therefore specific description of such operation is not repeated. The control valve 111 is easily assembled, and its movable portions including the diaphragm assembly 119, the diaphragm 141, etc., are made light weight, so that it can have a high responsiveness.

While we have shown and described several embodiments in accordance with the present invention, it is to be understood that the same is not limited thereto but is susceptible of numerous changes and modifications as are obvious to those of ordinary skill in the art, and we therefore do not wish to be limited to the details shown and described herein but intend to cover all such changes and modifications known to those skilled in the art.

What is claimed is:

1. A control valve for an exhaust recirculation apparatus of an internal combustion engine, which controls an exhaust gas recirculation valve provided in an exhaust recirculation passage which leads exhaust gas from the engine back to the engine for controlling the quantity of exhaust gas recirculated in the exhaust recirculation passage according to the degree of vacuum at a venturi portion of a carburetor and the exhaust pressure in an exhaust inflow chamber defined in the exhaust recirculation passage by an orifice and the exhaust gas recirculation valve, comprising:

an expansible vacuum chamber having a first diaphragm and communicating with said venturi portion of a carburetor;

an expansible exhaust pressure chamber having a second diaphragm arranged such that the second diaphragm opposes the first diaphragm of the expansible vacuum chamber and is spaced therefrom, the expansible exhaust pressure chamber communicating with said exhaust inflow chamber;

a control chamber defined by the first diaphragm, the second diaphragm, and a frame mounting the first and second diaphragm thereon, the control chamber communicating with atmosphere through a hole in the frame;

connecting means for mechanically connecting the first diaphragm and the second diaphragm;

a seal member provided in said control chamber so as to move with said connecting means;

a control passage disposed in the control chamber and communicating with a throttle portion of the carburetor and with said exhaust gas recirculation valve, and having an opening in said control chamber which faces said seal member and is spaced therefrom so that said opening is throttled by movement of said seal member with respect thereto; and a spring urging said first diaphragm in a direction such that the gap between said seal member and said opening of the control passage will be increased.

2. The control valve for an exhaust recirculation apparatus as defined in claim 1, wherein the connecting means comprises a bracket secured to the first diaphragm with the help of a backing plate to form a diaphragm assembly, the bracket having a cup-shaped portion on which the second diaphragm is secured.

3. The control valve for an exhaust recirculation apparatus as defined in claim 2, wherein said seal member is mechanically connected to said bracket.

4. The control valve for an exhaust recirculation apparatus as defined in claim 3, wherein said control passage is defined in a conduit secured to said frame, and said opening is provided in one end of the conduit disposed in the cup-shaped portion of said bracket and passing through a hole in the side wall of the cup-shaped portion.

5. The control valve for an exhaust recirculation apparatus as defined in claim 1, wherein said connecting means comprises a connecting rod one end of which is connected to the first diaphragm which is secured between a first pair of backing plates, the other end of which is connected to the second diaphragm through a second pair of backing plates.

6. the control valve for an exhaust recirculation apparatus as defined in claim 5, wherein said control passage is defined in the frame, and the opening of the passage faces the seal member which is disposed around said connecting rod.

7. In an exhaust recirculation system for an internal combustion engine including an exhaust recirculation passage which supplies exhaust gas from the engine back to the engine gas intake and an exhaust gas recirculation valve provided in said exhaust recirculation passage for controlling the quantity of exhaust gas recirculated through said passage to the engine in accordance with the degree of vacuum at a venturi portion of the engine carburetor, a control valve for controlling said exhaust gas recirculation valve in accordance with the degree of vacuum at said venturi portion and the exhaust pressure in said passage upstream of said exhaust gas recirculation valve, comprising a hollow valve body having first and second diaphragms disposed therein in spaced, substantially parallel relationship to form first, second, third chambers, said second chamber being disposed between said first and second diaphragms;

connecting means for interconnecting said first and second diaphragms to effect conjoint movement thereof;

biasing means in one of said chambers for biasing said first and second diaphragms in a predetermined direction;

means for connecting said first chamber to said venturi portion of said engine carburetor;

means for connecting said third chamber to said exhaust recirculation passage upstream of said gas recirculation valve;

a conduit connected between a throttle portion of the engine carburetor and said exhaust gas recirculation valve;

a control passage with one end connected to said conduit and the opposite end providing an opening into said second chamber, said valve body having an opening therein into said second chamber; and a seal member secured to one of said diaphragms at a position opposite and closely spaced with respect to said opening of said control passage to selectively throttle said opening with movement of said diaphragms.

8. A control valve as defined in claim 7 wherein said connecting means comprises a cup-shaped member, said seal member being disposed in said cup-shaped member and said control passage being provided as a conduit extending through an opening in the side wall of said cup-shaped member.

9. A control valve as defined in claim 7 wherein said connecting means comprises a connecting rod disposed in said second chamber and being secured at the ends thereof to said first and second diaphragms, respectively.

10. A control valve for controlling the pressure in a conduit connected to a pressure source comprising:

a hollow valve body having first and second diaphragms disposed therein in spaced, substantially parallel relationship to form first, second and third chambers, said second chamber being disposed between said first and second diaphragms;

connecting means for rigidly interconnecting said first and second diaphragms to effect conjoint movement thereof;

means for connecting said first chamber to a source of variable positive pressure;

means for connecting said third chamber to a source of variable negative pressure;

means for connecting said second chamber to atmosphere;

a control passage connecting said conduit to said second chamber including an opening in said control passage disposed in said second chamber;

a seal member secured to one of said diaphragms within said second chamber at a position opposite and closely spaced with respect to said opening of said control passage to selectively throttle said opening with movement of said diaphragms; and biasing means in one of said chambers for biasing said diaphragms in a direction to increase the spacing of said seal member from said opening.

* * * * *